US005680940A

United States Patent [19]

D'Angelo

[11] Patent Number: 5,680,940

[45] Date of Patent: Oct. 28, 1997

[54] SPACE SAVING BRACKET

[76] Inventor: John Carl D'Angelo, 1637 E. Valley Pkwy., Apt. #179, Escondido, Calif. 92027

[21] Appl. No.: 680,798

[22] Filed: Jul. 16, 1996

[51] Int. Cl.[6] ..... A47F 5/08

[52] U.S. Cl. ..... 211/90; 211/87; 211/70.6

[58] Field of Search ..... 211/90, 87, 70.6, 211/66; 248/215, 220.1, 317, 320

[56] References Cited

U.S. PATENT DOCUMENTS

| | | | |
|---|---|---|---|
| 1,056,530 | 3/1913 | Freirich | 248/220.1 |
| 1,159,813 | 11/1915 | Volkhardt | 248/220.1 X |
| 1,259,628 | 3/1918 | Herrick | 211/70.6 X |
| 1,286,588 | 12/1918 | Goodykoontz | 248/220.1 X |
| 1,613,447 | 1/1927 | Ellberg | 211/87 X |
| 1,814,692 | 7/1931 | Harris | 211/87 X |
| 1,852,514 | 4/1932 | Grady | 211/87 |
| 1,856,044 | 4/1932 | Stowell | 211/87 X |
| 1,870,729 | 8/1932 | Hulseberg | 211/87 |
| 2,049,594 | 8/1936 | Stultz | 211/87 X |
| 2,487,301 | 11/1949 | Borah | 211/90 X |
| 2,572,797 | 10/1951 | Zimmer | 211/70.6 |
| 2,582,006 | 1/1952 | Cedarleaf | 211/66 |
| 2,604,997 | 7/1952 | Pearson | 211/66 |
| 3,002,666 | 10/1961 | Silverman | 211/87 |
| 3,141,712 | 7/1964 | Holmes et al. | 211/66 X |
| 3,721,348 | 3/1973 | Cook | 211/70.6 |
| 3,985,324 | 10/1976 | Larson | 211/70.6 X |
| 4,060,215 | 11/1977 | Burns et al. | 211/66 X |
| 4,730,738 | 3/1988 | Bartus et al. | 211/90 |
| 4,798,297 | 1/1989 | Weiss et al. | 211/65 |
| 4,880,192 | 11/1989 | Brauche | 211/70.6 |
| 4,905,951 | 3/1990 | Putness | 211/70.6 |
| 5,097,966 | 3/1992 | Miller | 211/70.6 |
| 5,322,256 | 6/1994 | Kanwischer | 211/70.6 X |
| 5,388,709 | 2/1995 | Adams | 211/70.6 |

*Primary Examiner*—Alvin C. Chin-Shue
*Assistant Examiner*—Sandra Snapp
*Attorney, Agent, or Firm*—Patent & Trademark Services, Inc.; Joseph H. McGlynn; Thomas Zack

[57] ABSTRACT

A space saving bracket having a horizontally extending leg with a series of aligned spaced pin hooks to receiving articles, such as tools or kitchen utensils, to be vertically hung from them. Each hook is rotatably mounted to the bracket to receive an article and to engage a hole in the article. The article may have a holed device fixed to the article, such as an eye screw, to vertically hang the article or it may have an upper receiving hole drilled in it. Two or more angled brackets can be aligned to support a shelf extending between them.

6 Claims, 2 Drawing Sheets

FIG. 1
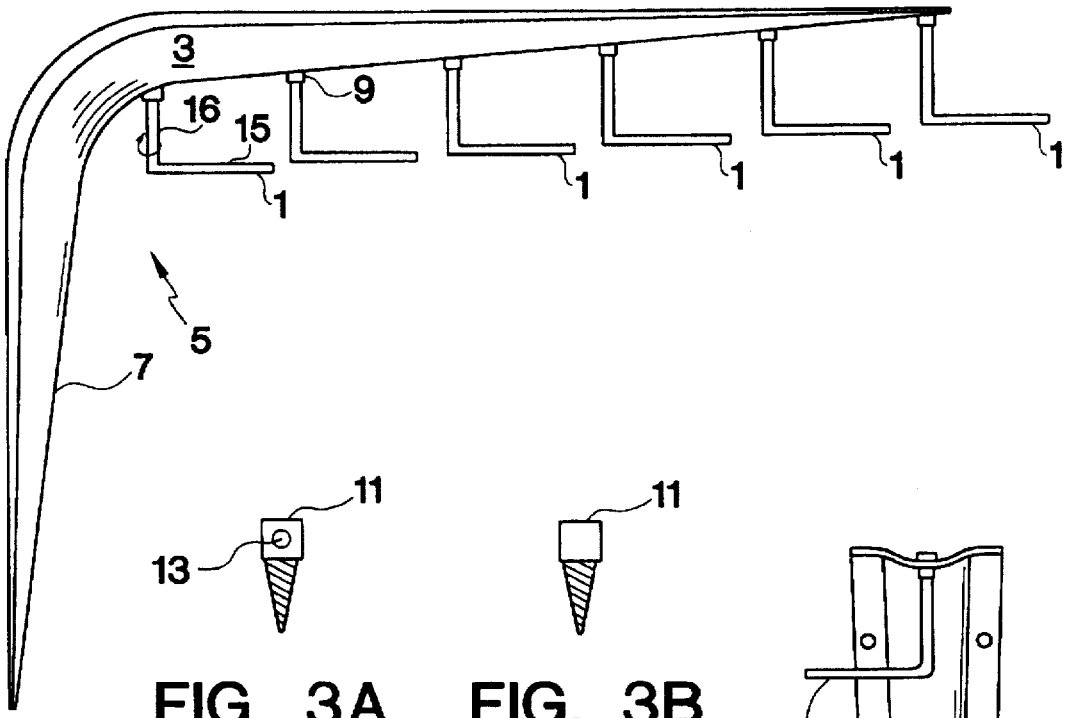
FIG. 3A
FIG. 3B
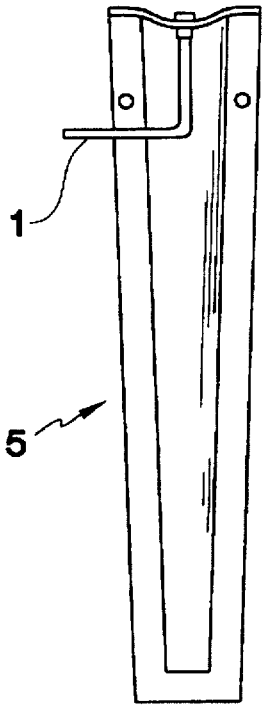
FIG. 2
FIG. 4
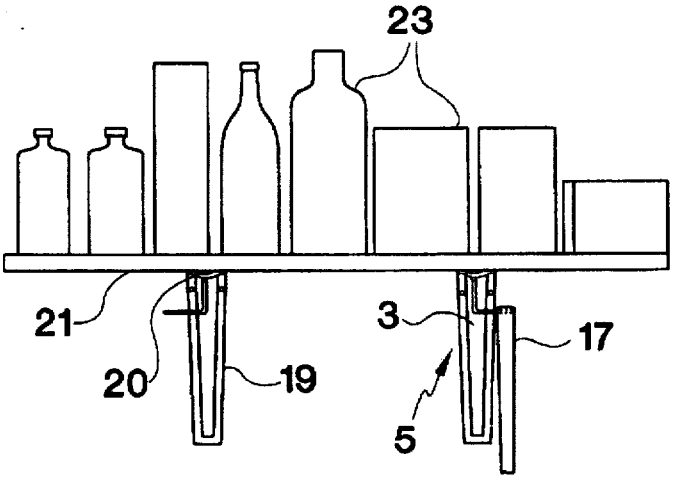

SPACE SAVING BRACKET

BACKGROUND OF THE INVENTION

The present invention relates to an organizer for various articles such as tools and utensils. A right angled specially designed bracket has a horizontal arm or leg with a series of aligned rotatable attached opened pin hooks. These pin hooks mate with complementary structure on the articles which are to be vertically hung from them. There is a substantial savings in space used for storage with this invention. When two or more of brackets are horizontally aligned, a shelf may be attached between their extending horizontal legs.

DESCRIPTION OF THE PRIOR ART

In the prior art various types of hooks and brackets are known to vertically hang articles such as tools and utensils in garages, kitchens, work shops, etc.. This includes peg boards with metal pin or hooks mounted in them and other types of handled tool suspension devices such as shown in U.S. Pat. No. 5,097,966 to G. Miller. Still other inventions are disclosed in the U.S. Pat. Nos. 4,880,192 to Von Braucke et al.; 4,905,951 to C. Putness; and 5,388,709 to T. Adams. Each is able to vertically hold an article and each can be attached to a vertical support surface such a garage wall. My invention also provides vertical article support, however, it does so by employing a single bracket capable of hanging many articles from a series of aligned hooks on the bracket's vertically extending horizontal leg as disclosed and claimed herein.

SUMMARY OF THE INVENTION

The present invention consists of a space saving bracket having a series of aligned spaced pin hooks on the bracket's extended horizontal leg. The article to be hung from each pin hook are modified to mate with the pin hooks. This modification may done several ways such as having a hole made in the article's upper handle or by using a holed fastener such as an eye screw fixed to the article. Two or more aligned brackets may have a shelf extend their horizontally extending legs.

It is an object of the present invention to provide an improved bracket for hanging articles.

It is a further object of the present invention to provide a bracket which will permit more articles to be hung in a given space.

It is another object of the present invention to provide an improved bracket whose extending legs can also be used to support a shelf.

These and other objects and advantages of the present invention will be fully apparent from the following description, when taken in connection with the annexed drawings.

BRIEF DESCRIPTION OF THE DRAWINGS

FIG. 1 is side view of the present invention showing six aligned pin hooks.

FIG. 2 is a front view of the present invention with one of its pin hooks rotated.

FIG. 3A and FIG. 3B are two different views of a typical eye screw used to attach a device to a pin hook.

FIG. 4 depicts my invention with two aligned brackets supporting a shelf.

DESCRIPTION OF THE PREFERRED EMBODIMENT

Figure 5:
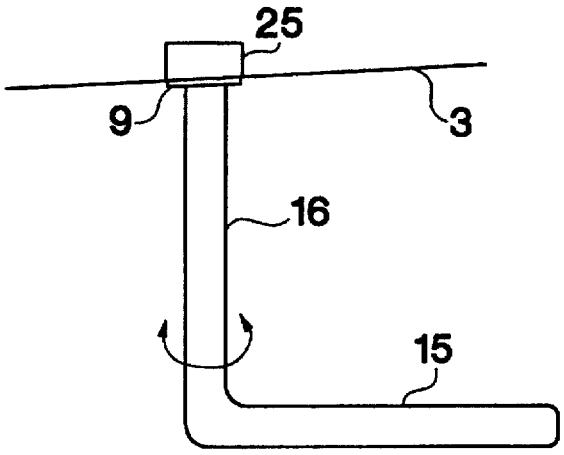
FIG. 5 shows an enlarged view of a pin hook mounted to the bracket.

Referring now to the drawings in greater detail, the FIG. 1 side view shows the pin hooks 1 mounted in a hole in to the horizontal arm or leg 3 of the space saver right angled bracket 5. The bracket's base vertical leg 7 is fixedly mounted to a vertical support structure such a garage, work shop or house wall. For illustration purposes six aligned identical pin hooks 1 are shown. Clearly, the number of pin hooks can vary based factors such as the user's desire and space constraints. While the pin hooks nearer the leg's free end are slightly elevated from those nearer the vertical support structure, they can be considered generally aligned with each other in a vertical plane.

Each pin hook is mounted in a hole in the bracket's leg and secured in place by a retaining washer 9 which provides for the pin hooks easy rotation, vertical support while eliminating horizontal movement. FIG.2 shows one of the pin hooks rotated 90 degrees to what may be called an article receiving position. By providing for the pin hook's rotation a larger number of articles or devices may easily and conveniently be hung in a given space.

FIG. 3A and FIG. 3B show two views of an eye screw 11 which can be used to provide a complementary mating hole for the pin hooks. This eye is screwed or fixed into the top the article to be hung. The hole 13, slightly larger than the diameter of horizontal pin hook leg 15, allows the eye screw and attached article to be hung thereon. Normally, this is done by rotating the pin hook as shown in FIG. 2. to a receiving position. Once the article is placed on the pin hook's leg, the pin hook is again rotated about its vertical leg 16 back 90 degrees to the FIG.1 storage position. The weight of the hung article keeps it in the stored position while the unique positioning of the pin hooks prevent the articles from accidentally sliding off when maintained in the storage position.

A great variety of complementary mating devices may be used to modify the article to be hung. One could simply drill a hole in the upper handle or surface of the article larger than the horizontal leg's cross sectional area and slide the holed article's surface over the pin hook. Eye hooks or other fasteners fixed to the article with mating complementary surfaces could also be used as long as they can engage the pin hooks and hold the article thereon.

FIG. 4 shows an article 17, in this case tools with a hole in its upper handle, substantially vertically aligned. One tool can be mounted in a similar fashion on each of the bracket's pin hooks in a stored position. Another identical bracket 19, shown with no articles thereon, has its top surface of upper arm or leg 20 substantially horizontally aligned with the top surface of leg 3. A horizontal shelf 21 extends between these two brackets and is attached to them. Holes may be drilled in the brackets'legs and shelf and nuts and bolts used attached the shelf to them. Various articles 23 typically found in a garage, kitchen or work shop can be placed on this shelf. FIG. 5 an enlarged view of the pin hook 1 as mounted in the bracket's horizontal leg 3. The pin's horizontal leg 15 receives and mounts the article to be hung and the vertical leg 16 upper end has the washer 9 mounted on it. The upper enlarged retaining head 25 of the pin hook is larger in cross sectional diameter than the pin hook and the bracket's hole in which mounted. Head 25 is mounted over the bracket's hole to prevent the pin hook from falling through the hole while insuring the pin hook can support the weight of a hung article. This engagement also insures the pin hook can rotate to both receive and store articles.

Figure 6:
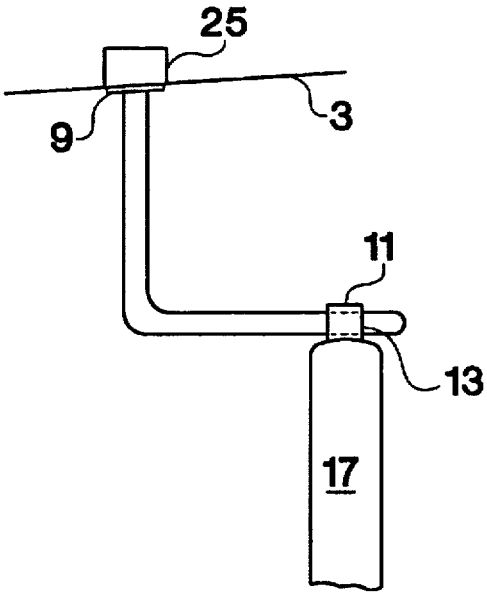
FIG. 6 illustrates a hanging article with an eye screw mounted to a pin hook.

FIG. 6 shows how a typical article 17, the handle of a rake, is mounted with the eye screw 11 on its top and the pin's horizontal leg 15 extending through the screw's hole 13.

I have used the term article or articles to describe what may be vertically hung from the pin hooks. This term includes any type of item which can be hung and is not limited to tools and kitchen utensils.

The space saver bracket is not limited in use to hanging tools in garages and kitchen utensils in kitchens or pantries. It can be used in any home or business for hanging store displays or for hanging articles in a house, closet or work shop.

Although the Space Saver and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A space saving bracket combined with at least one article to be hung from a hook on the bracket comprising:

a bracket having a support structure engaging leg for vertically supporting the bracket and a substantially horizontally disposed extending leg approximately perpendicular to the support structure leg;

a plurality of aligned depending spaced hooks each having an extending leg having a free end and being rotatably mounted on their upper end to the bracket's substantially horizontally disposed extending leg, each of said hooks being capable of vertically mounting an article on its leg free end; and a hook mounted article having means for engaging the hook's leg free end and vertically supporting the article in a hung position.

2. The invention as claimed in claim 1 wherein each of said rotatable hooks are mounted to the bracket's extending leg and spaced a sufficient distance from the nearest hook to accommodate an upper handle of an article on each hook.

3. The invention as claimed in claim 2, where said means for engaging and vertically supporting a hung article has a hole therein to engage each hook leg at its free end, said hook leg being smaller in cross section, at least in part, than said hole to permit the article to be hung thereon.

4. The invention as claimed in claim 2, wherein said means for engaging and vertically supporting a hung article is the interior article surface formed by a hole in the upper portion of the article to be hung, said hole having a diameter greater than, at least in part, the cross section of the hook's horizontally extending leg.

5. The invention as claimed in claim 1, wherein each of the legs for the depending hooks extends substantially horizontally.

6. A shelf combined with two spaced support brackets with at least one article to be hung from a hook on the brackets comprising:

two spaced aligned brackets each bracket having a support structure engaging leg and a substantially horizontally disposed extending leg approximately perpendicular to the support structure leg;

each of the brackets also having a plurality of aligned depending spaced hooks, each hook having a leg with a free end and being rotatably mounted on its upper end to the bracket's substantially horizontally disposed extending leg, each of said hooks being capable of vertically mounting an article on its leg free end;

means on the mounted article for engaging the hook's free end and vertically supporting the article in a hung vertically disposed position; and an upper support shelf extending to and mounted on the two aligned brackets capable of supporting objects thereon.

* * * * *